United States Patent [19]

Murasawa et al.

[11] 4,275,136

[45] Jun. 23, 1981

[54] LIQUID DEVELOPER FOR COLOR ELECTROPHOTOGRAPHY

[75] Inventors: Sadao Murasawa, Itami; Masatsuyo Maruo, Moriyama, both of Japan

[73] Assignee: Ishihara Sangyo Kaisha, Ltd., Osaka, Japan

[21] Appl. No.: 143,124

[22] Filed: Apr. 23, 1980

[30] Foreign Application Priority Data

Apr. 27, 1979 [JP] Japan ..... 54-52376

[51] Int. Cl.[3] ..... G03G 9/18

[52] U.S. Cl. ..... 430/117; 430/115; 430/904; 430/114; 430/45; 106/308 B

[58] Field of Search ..... 430/112, 114, 115, 44, 430/45, 46, 117; 106/308 B

[56] References Cited

U.S. PATENT DOCUMENTS

| | | | |
|---|---|---|---|
| 2,891,911 | 6/1959 | Mayer | 430/114 X |
| 3,545,994 | 12/1970 | Lott, Jr. et al. | 106/308 B |
| 3,850,830 | 11/1974 | Fukushima et al. | 430/114 |

FOREIGN PATENT DOCUMENTS 1355442 6/1974 United Kingdom .

OTHER PUBLICATIONS

Chemical Abstracts, vols. 75/50529y, 50/2188g, 53/18509fg.

*Primary Examiner*—John D. Welsh
*Attorney, Agent, or Firm*—Cushman, Darby & Cushman

[57] ABSTRACT

This invention relates to a liquid developer for use in color electrophotography for obtaining a photographic image by subjecting an electrostatic latent image to liquid development, and more particularly it relates to such a liquid developer for electrophotography comprising a coloring agent, a binder and an electrically insulating liquid, the particles of said coloring agent having coated or distributed thereon aluminum or zinc hydroxide.

10 Claims, 2 Drawing Figures

LIQUID DEVELOPER FOR COLOR ELECTROPHOTOGRAPHY

Figure 1:
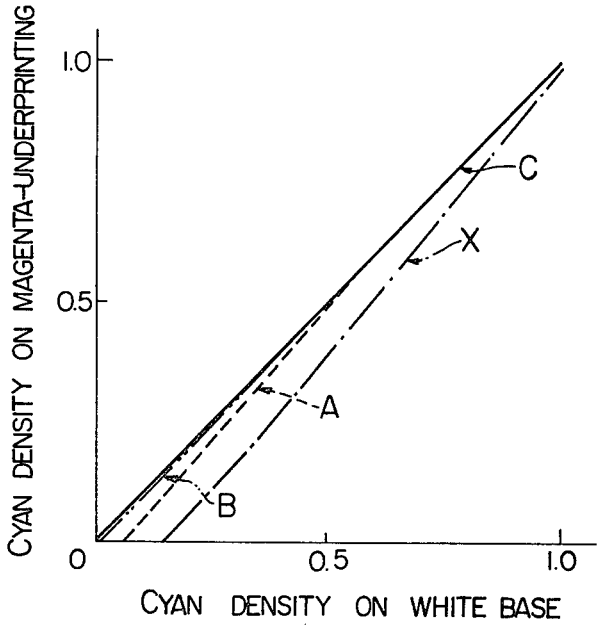

This invention relates to a liquid developer for visualizing electrostatic latent images in color electrophotography, and more particularly, it relates to a liquid developer which makes it possible to obtain an image of high quality in multi-color printing according to an electrofax process.

For forming a color image on the surface of, for example, a zinc oxide photoreceptor according to the electrofax process, there is usually employed a method in which the steps of electric charging, exposure and development are repeated on the same photoreceptor corresponding to the number of color separations. In the case of an image of three colors, for instance, multi-color printing is performed in the following three stages in order to avoid photo-absorption by toner layer: the first stage comprises blue light exposure-development with a yellow developer, the second stage comprises green light exposure-development with a magenta developer and the third stage comprises red light exposure-development with a cyan developer.

With such multi-color printing techniques, however, it is hardly possible to obtain an image of high quality. For instance, when an upper printing toner is put on the image layer of an underprinting, particularly when an upper printing toner having a low image density is applied to an underprinting having a high image density, the upper printing toner is not sufficiently attached to the underprinting, and hence, the resulting print is poor in multi-color printing properties, and no exact reproduce of color is obtained. Also, there takes place a flow of image (or streaks) in the upper printing toner image on the image layer of underprinting. For these reasons, no high quality image is obtained.

Many methods for the preparation of a liquid developer for improving the multi-color printing properties and removing the flow of image or streaks have been proposed. For instance, British Pat. No. 1,355,442 shows a method using specific resins such as half-alkylamide of maleic acid-diisobutylene copolymer, or the like. Neverthless, no fundamental solutoin has been reached for obtaining a high-quality image, and improvements are now being made from the aspect of apparatus particularly for solving the problem of flow of image or streaks.

The present inventors have produced a liquid developer for color electrophotography using a coloring agent having coated or distributed thereon a specified metal hydroxide and have carried out multi-color printing using said liquid developer, whereby it has been found that the use of said liquid developer can greatly improve the multi-color printing properties of the upper printing toner on the image layer of an underprinting and can diminish the flow of image or streaks, resulting in formation of an image of high quality.

Thus, the present invention provides a liquid developer for color electrophotography comprising an electrically insulating liquid, a coloring agent and a binder, characterized in that the particles of the coloring agent have coated or distributed thereon aluminum or zinc hydroxide.

The term "particles of coloring agent having coated or distributed thereon aluminum or zinc hydroxide" used herein means particles of coloring agent obtained by depositing on the coloring agent particles in an aqueous slurry of aluminum hydroxide obtained by alkali-neutralization of aluminum chloride, hydrolysis of an organoaluminum compound, acid-neutralization of sodium aluminate, or by other means, or of zinc hydroxide obtained by alkali-neutralization of zinc chloride, zinc sulfate or the like, and the term "coated or distributed" means that the coloring agent particles are covered with a continuous film of said hydroxide or a discontinuous film of said hydroxide is adhered onto the particles of the coloring agent.

The amount of said hydroxide cannot be uniquely defined as it is variable depending on the type of the coloring agent used, but usually the hydroxide is used in an amount of at least 2% by weight, preferably 5 to 50% by weight, more preferably 15 to 40% by weight as $Al_2O_3$ or ZnO, based on the weight of the coloring agent. If the amount of the hydroxide is below said range, the effect of this invention is not obtained. Aluminum hydroxide is more advantageous than zinc hydroxide in view of economy and effect.

As for the coloring agent used in this invention, there may be employed various known types of organic or inorganic pigments including chromatic pigments such as chrome type pigments, cadmium type pigments, azo type pigments, lake colors, quinacridone, altramarine blue, berlin blue, phthalocyanine, etc., and achromatic pigments such as zinc white, titanium white, carbon black, iron oxide black, etc.

The coloring agent particles having coated or distributed thereon aluminum or zinc hydroxide which are used in this invention may be obtained in the following way: A coloring agent is added to water, or water having added thereto a small quantity of a surfactant or a mixture of water and a water-miscible solvent such as an alcohol, and the resulting mixture is stirred, to which aluminum chloride, zinc chloride or zinc sulfate is added. The resulting mixture is then heated with sufficient stirring. To the mixture is further added an aqueous solution of an alkali such as sodium hydroxide, potassium hydroxide, ammonia, etc., to neutralize the mixture, after which the mixture is aged for about 30 minutes. The coloring agent is then separated by filtration, washed with water, dried and milled, to obtain coloring agent particles having coated or distributed thereon aluminum or zinc hydroxide.

The thus obtained coloring agent particles are dispersed in an electrically insulating liquid together with a resin binder, and optionally a charge-controlling agent and the like in a conventional manner to prepare the liquid developer for color electrophotography of this invention.

A wide variety of known dispersion media such as liquid normal-paraffinic hydrocarbons, iso-paraffinic hydrocarbons, halogenated hydrocarbons, xylene, toluene, carbon tetrachloride, etc., may be used as the electrically insulating liquid in this invention, though in order for other materials not to be dissolved, it is preferred to use iso-paraffinic hydrocarbons which have a relatively small dissolving power.

As for the binder, there may be used various types of resins such as acrylic resins, styrene resins, styrene-butadiene copolymers, alkyd resins, rosin-modified phenol resins, cumarone resins, natural rubber, linseed oil, etc. As the charge-controlling agent, a metal salt of an ordinarily used organic acid such as zirconium octenate, zirconium naphthenate, etc., may be added.

The liquid developer for color electrophotography according to this invention can be applied to zinc oxide photoreceptors, titanium oxide photoreceptors and photo-sensitive films made of an organic substance such as polyvinyl carbazol.

Figure 2:
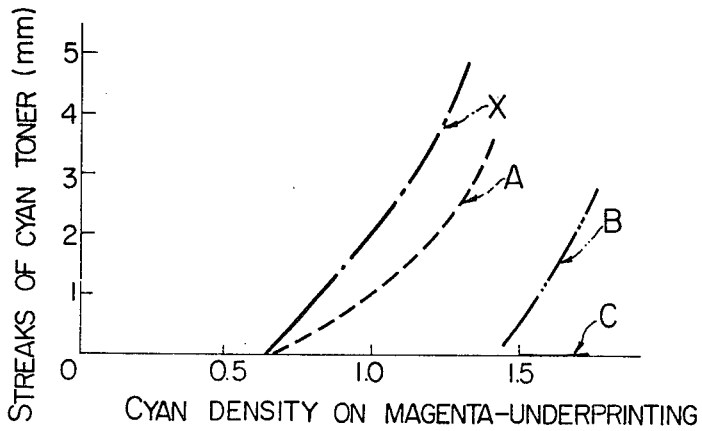

The liquid developer of this invention is illustrated below by Examples, and it is shown that the multi-color printing properties of upper printing toner on the image layer of underprinting and the flow of image (streaks) are greatly improved by use of the liquid developer of this invention, referring to the accompanying drawings, in which FIG. 1 is a graph showing the relation between cyan density on white base and cyan density on magenta-underprinting for illustrating the multi-color printing properties where the liquid developer for electrophotography of this invention and a comparative liquid developer are used, and FIG. 2 is a graph showing the relation between cyan density on magenta-underprinting and cyan toner streaks for illustrating the flow of upper printing toner where the liquid developer for electrophotography of this invention and a comparative liquid developer are used. In the drawings, A: Liquid developer in which a coloring agent treated with 5% by weight (as $Al_2O_3$) of aluminum hydroxide is used.

B: Liquid developer is which a coloring agent treated with 10% by weight (as $Al_2O_3$) of aluminum hydroxide is used.

C: Liquid developer in which a coloring agent treated with 20% by weight (as $Al_2O_3$) of aluminum hydroxide is used.

X: Comparative liquid developer in which a non-treated coloring agent is used.

EXAMPLE 1

Treatment of coloring agent

In the preparation of the liquid developer for color electrophotography of this invention, a coloring agent having coated thereon aluminum hydroxide was prepared in the following manner:

In a container was placed 1.2 liters of a 10% by weight aqueous solution of ethyl alcohol, and 30 g of each of the coloring agents shown in Table 1 was then added to the solution, and the mixture was stirred thoroughly. Further, aluminum chloride ($AlCl_3.6H_2O$) was added in the amount (as $Al_2O_3$) indicated in Table 1 (the percentage shown in Table 1 is based on the weight of the coloring agent) and the mixture was heated with stirring. To maintain it at 60° C., during which 1 N aqueous sodium hydroxide was added dropwise to adjust the pH of the mixture to 7.0, thereby depositing aluminum hydroxide on the surfaces of the coloring agent particles. After allowing the mixture to age for 30 minutes at 60° C., the coloring agent was separated by filtration and washed with 2 liters of water. This was dried at 120° C. and milled in a mortar, to prepare treated coloring agents as shown in Table 1.

TABLE 1

| Name of treated coloring agent | Coloring agent used | Amount of aluminum chloride as $Al_2O_3$ (% by weight) |
|---|---|---|
| a-1 | Lionogen Magenta R (trade name for quinacridone pigment of Toyo Ink Co., Ltd.) | 5 |
| b-1 | Lionogen Magenta R (trade name for quinacridone pigment of Toyo Ink Co., Ltd.) | 10 |
| c-1 | Lionogen Magenta R (trade name for quinacridone pigment of Toyo Ink Co., Ltd.) | 20 |
| a-2 | Heliogen Blue 7100 (trade name for phthalocyanine pigment of BASF Co.) | 5 |
| b-2 | Heliogen Blue 7100 (trade name for phthalocyanine pigment of BASF Co.) | 10 |
| c-2 | Heliogen Blue 7100 (trade name for phthalocyanine pigment of BASF Co.) | 20 |

Preparation of liquid developer

Liquid developers were prepared in the following manner by using the treated coloring agents shown above.

Into a 100-ml glass bottle was put 0.5 g of each said treated coloring agent along with 7.7 g of a 25% iso-paraffinic hydrocarbon solution of Plexol 966 (trade name for an acrylic resin of Rohm & Haas Co.), 0.08 g of a charge-controlling agent and 11.2 g of an iso-paraffinic solvent. Glass beads were then added as milling medium, and the mixture was agitated by a paint shaker (manufactured by Red Devil Co.) for about 30 minutes, and 1 cc of the mixture was diluted to 100 cc with an iso-paraffinic hydrocarbon solvent. The thus prepared liquid developers are named as shown in Table 2.

TABLE 2

| Name of the liquid developers | Name of treated coloring agents used |
|---|---|
| A-1 | a-1 |
| B-1 | b-1 |
| C-1 | c-1 |
| A-2 | a-2 |
| B-2 | b-2 |
| C-2 | c-2 |

By way of comparison, there were similarly prepared liquid developers X-1 and X-2 in the same manner as above by using 0.5 g of non-treated Lionogen Magenta R and 0.5 g of Heliogen Blue 7100, respectively, instead of the treated coloring agents.

Determination of multi-color printing properties

Four sheets of $TiO_2$ photoreceptor were prepared. The left half surface of each sheet was masked with an aluminum plate, and the right half surface thereof was charged by a corona charger to provide a surface potential of −400 V. One of the sheets of photoreceptor was then immersed in one of the liquid developers for underprinting specified in Table 3 to form a magenta toner layer with a density of 1.0 on the right half surface of each of the four sheets of photoreceptor. The density referred to herein is a reflection density as measured by Densito-Meter RD-514 (manufactured by Mcbeth Co.)

The entire surface of each sheet of photoreceptor was again charged at −400 V by a corona charger, and Step Wedge No. 3 (manufactured by Eastman Kodak Co.) was placed on said photoreceptor and intimately adhered thereto so that the center line of the wedge might agree with the boundary line between the white portion and the magneta toner layer on the photoreceptor. This was followed by exposure to light from the upper sides to form a stepped electrostatic latent image. This latent image was developed by immersion in one of the liquid cyan developers for upper printing specified in Table 3 to form a step wedge image of cyan. Thus, toner-coated photoreceptors A-C nad X were obtained.

TABLE 3

| Name of developer-loaded photo-receptors | Name of developer for underprinting | Name of developer for upper print-ing |
|---|---|---|
| A | A-1 | A-2 |
| B | B-1 | B-2 |
| C | C-1 | C-2 |
| X | X-1 | X-2 |

The cyan density on the white base of the same step of the step wedge image of cyan and the cyan density on the magenta-underprinting (the absorption of red light by underprinted magenta toner has been deducted ) were measured for each of said toner-loaded photoreceptors by using the same densitometer as mentioned above. The data obtained were plotted on a coordinate in which the abscissa is used as cyan density on white base and the ordinate is used as cyan density on magenta-underprinting to obtain the results as shown in FIG. 1. It will be noted that the multi-color printing properties are improved by use of a liquid developer in which a coloring agent having coated thereon aluminum hydroxide is used.

Determination of flow

A rectangular sheet of $TiO_2$ photoreceptor (120×160 m/m) was charged over the entire surface by a corona charger to provide a surface potential of −400 V, exposed except rectangular part (12×16 m/m) and then immersed in one of the liquid developers specified in Table 4 to form a magenta toner layer (12×16 m/m) with a density of 1.0 on the photoreceptor. The density was measured in the same way as mentioned above. The photoreceptor was again charged, exposed in the same manner as above, and after adjusting the surface potential so that the cyan density of the solid image might become the desired one, the photoreceptor developing electrode, and a cyan developer was then poured into the space between the photoreceptor and the developing electrode at a relative velocity of 3 cm/sec, after which the photoreceptor was developed for 3 seconds. A cyan image was thus formed on the magenta solid image, resulting in a deep-blue rectangular solid image. The length (mm) of the streak running backwardly from the end of the solid image was measured. This measurement was conducted as to the respective liquid developers A, B, C and X. The values obtained were plotted on a coordinate in which the abscissa is used as cyan density of the solid image (the absorption of red light by the underprinted magenta toner has been deducted) and the ordinate is used as streaks of cyan toner at the above cyan density to obtain the results shown in FIG. 2. As seen from FIG. 2, the flow of image (streaks) is diminished by a liquid developer in which a coloring agent have coated thereon aluminum hydroxide, and no flow (streak) is formed when the coloring agent has been treated with 20% by weight of aluminum hydroxide.

TABLE 4

| Name of developer-loaded photoreceptors | Name of under-printing developers | Name of upper printing deve-lopers |
|---|---|---|
| A | A-1 | A-2 |
| B | B-1 | B-2 |

TABLE 4-continued

| Name of developer-loaded photoreceptors | Name of under-printing developers | Name of upper printing deve-lopers |
|---|---|---|
| C | C-1 | C-2 |
| X | X-1 | X-2 |

EXAMPLE 2

Treated coloring agents, as shown in Table 5, were prepared by depositing a predetermined amount (as ZnO) of zinc hydroxide as shown in Table 5 on the surfaces of the coloring agent particles in the same way as in Example 1, except that 2.6 g, 5.0 g or 10.0 g of zinc chloride ($ZnCl_2$) was substituted for the hydrated aluminum chloride.

TABLE 5

| Name of treated coloring agents | Coloring agents used | Amount of zinc chloride as ZnO (% by weight) |
|---|---|---|
| d-1 | Lionogen Magenta R | 5 |
| e-1 | " | 10 |
| f-1 | " | 20 |
| d-2 | Heliogen Blue 7100 | 5 |
| e-2 | " | 10 |
| f-2 | " | 20 |

By using the treated coloring agents, there were prepared the liquid developers indicated in Table 6 in the same manner as in Example 1.

TABLE 6

| Name of developers | Name of treated coloring agents used |
|---|---|
| D-1 | d-1 |
| E-1 | e-1 |
| F-1 | f-1 |
| D-2 | d-2 |
| E-2 | e-2 |
| F-2 | f-2 |

By using the above liquid developers D-1 to F-2 and the same developers X-1 and X-2 as in Example 1, and the ZnO photoreceptor, the multi-color printing properties and flow of image were determined in the same manner as in Example 1, to obtain the substantially the same results as those illustrated in FIGS. 1 and 2.

EXAMPLE 3

Treated coloring agents, as shown in Table 7, were prepared by depositing a predetermined amount (as $Al_2O_3$) of aluminum hydroxide as shown in Table 7 on the surfaces of coloring agent particles in the same manner as Example 1, except that sodium aluminate ($NaAlO_2$) was substituted for the hydrated aluminum chloride and 1 N hydrochloric acid solution was substituted for the 1 N sodium hydroxide solution.

TABLE 7

| Name of treated coloring agents | Coloring agents used | Amount of sodium alumi-nate as $Al_2O_3$ (% by weight) |
|---|---|---|
| g-1 | Lionogen Magenta R | 5 |
| h-1 | " | 10 |
| i-1 | " | 20 |
| g-2 | Heliogen Blue 7100 | 5 |
| h-2 | " | 10 |
| i-2 | " | 20 |

By using the above treated coloring agents, liquid developers as shown in Table 8 were produced in the same manner as in Example 1.

TABLE 8

| Name of developers | Name of treated coloring agents used |
|---|---|
| G-1 | g-1 |
| H-1 | h-1 |
| I-1 | i-1 |
| G-2 | g-2 |
| H-2 | h-2 |
| I-2 | i-2 |

By using the above liquid developers G-1 to I-2 and the same developers X-1 and X-2 as in Example 1 and $TiO_2$ photoreceptor, the multi-color printing properties and flow of image were determined in the same manner as in Example 1, to obtain substantially the same results as illustrated in FIGS. 1 and 2.

EXAMPLE 4

In a container was placed 1,200 cc of Isopar G (trade name for iso-paraffinic hydrocarbon of Esso Kagaku K.K.), followed by addition thereto of 30 g of one of the coloring agents shown in Table 9, and the resulting mixture was stirred well. To the mixture was added aluminum iso-propoxide in the amount shown in Table 9, and the resulting mixture was heated with stirring. To this mixture maintained at 60° C. was added dropwise 50 cc of pure water to effect hydrolysis, thereby depositing aluminum hydroxide on the surfaces of the coloring agent particles. The coloring agent was then collected by filtration, dried at 120° C. and milled by means of a mortar. Treated coloring agents as shown in Table 9 were thus prepared.

TABLE 9

| Name of treated coloring agents | Coloring agents used | Amount of aluminum isopropoxide as $Al_2O_3$ (% by weight) |
|---|---|---|
| j-1 | Lionogen Magenta R | 5 |
| k-1 | " | 10 |
| l-1 | " | 20 |
| j-2 | Heliogen Blue 7100 | 5 |
| k-2 | " | 10 |
| l-2 | " | 20 |

The developers of Table 10 were prepared by using the above treated coloring agents in the same manner as in Example 1.

TABLE 10

| Name of developers | Name of treated coloring agents used |
|---|---|
| J-1 | j-1 |
| K-1 | k-1 |
| L-1 | l-1 |
| J-2 | j-2 |
| K-2 | k-2 |
| L-2 | l-2 |

By using the above liquid developers J-1 to L-2 and the same developers X-1 and X-2 as in Example 1 and $TiO_2$ photoreceptor, the multi-color printing properties and flow of image were determined in the same manner as in Example 1, to obtain substantially the same results as shown in FIGS. 1 and 2.

EXAMPLE 5

Treated coloring agents as shown in Table 11 were formed in the same manner as in Example 4, except that Chrome Fine Yellow 5910 (trade name for azo-type yellow pigment of Dainichi Seika Kogyo Co.) was used as the coloring agent.

TABLE 11

| Name of treated coloring agents | Name of coloring agents used | Amount of aluminum isopropoxide as $Al_2O_3$ (% by weight) |
|---|---|---|
| j-3 | Chrome Fine Yellow 5910 | 5 |
| k-3 | " | 10 |
| l-3 | " | 20 |

Liquid developers as shown in Table 12 were prepared by using the above treated coloring agents in the same manner as in Example 1.

TABLE 12

| Name of developers | Name of treated coloring agents used |
|---|---|
| J-3 | j-3 |
| K-3 | k-3 |
| L-3 | l-3 |

By using the above liquid developers J-3 to L-3 as well as the liquid developers J-1 to L-1 and J-2 to L-2 of Example 4 and the $TiO_2$ photoreceptor, the multi-color printing properties and flow of image were determined in the same manner as in Example 1, except that a yellow toner layer with a density of 1.0 was formed under the magenta toner layer, to obtain substantially the same results as shown in FIGS. 1 and 2.

What is claimed is:

1. A color electrophotographic process for color imaging on ZnO, $TiO_2$ or organic photoreceptors comprising forming multi-electrostatic images and developing said images with a developing composition comprising an electrically insulating liquid, a coloring agent and a binder, the particles of said coloring agent having coated or distributed thereon aluminim or zinc hydroxide.

2. The process according to claim 1, wherein the amount of the hydroxide is at least 2% by weight as $Al_2O_3$ or ZnO, based on the weight of the coloring agent.

3. The process according to claim 1, wherein the amount of the hydroxide is 5 to 50% by weight as $Al_2O_3$ or ZnO based on the weight of the coloring agent.

4. The process according to claim 1, wherein the amount of the hydroxide is 15 to 40% by weight as $Al_2O_3$ or ZnO based on the weight of the coloring agent.

5. The process according to claim 1, 2, 3 or 4, wherein the hydroxide is aluminum hydroxide

6. The process according to claim 1, 2, 3 or 4, wherein the coloring agent is an organic or inorganic pigment.

7. The process according to claim 1, 2, 3 or 4, wherein the coloring agent is a chromatic pigment selected from the group consisting of chrome type pigments, cadmium type pigments, azo type pigments, lake colors, quinachridone, ultramarine blue, berlin blue and phthalocyanine or an achromatic pigment selected from the group consisting of zinc white, titanium white, carbon black and iron oxide black.

8. The process according to claim 1, 2, 3 or 4, wherein the electrically insulating liquid is selected from normal-paraffinic hydrocarbons, iso-paraffinic hydrocarbons, halogenated hydrocarbons, xylene, toluenes and carbon tetrachloride.

9. The process according to claim 1, 2, 3 or 4, wherein the binder is selected from the group consisting of acrylic resins, styrene resins, styrene-butadiene copolymers, alkyd resins, rosin-modified phenol resins, cumarone resins, natural rubber and linseed oil.

10. The process according to claim 1, 2, 3 or 4, wherein the toner further comprises a charge-controlling agent selected from the group consisting of zirconium octenate and zirconium naphthenate.

* * * * *